US007823637B2

(12) United States Patent
Corbett et al.

(10) Patent No.: US 7,823,637 B2
(45) Date of Patent: Nov. 2, 2010

(54) DELAYED ACTING GRAVEL PACK FLUID LOSS VALVE

(75) Inventors: Thomas G. Corbett, Willis, TX (US); William N. Triplett, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 302 days.

(21) Appl. No.: 11/968,994

(22) Filed: Jan. 3, 2008

(65) Prior Publication Data

US 2009/0173503 A1 Jul. 9, 2009

(51) Int. Cl.
*E21B 43/04* (2006.01)
*E21B 34/12* (2006.01)

(52) U.S. Cl. ..... 166/166; 166/51; 166/278; 166/373

(58) Field of Classification Search ..... 166/278, 166/373, 381, 51, 166, 334.1, 72, 64
See application file for complete search history.

(56) References Cited

U.S. PATENT DOCUMENTS 3,696,865 A * 10/1972 Chapman ..... 166/64
4,601,342 A 7/1986 Pringle
4,641,707 A 2/1987 Akkerman
6,789,623 B2 * 9/2004 Hill et al. ..... 166/278
6,983,795 B2 1/2006 Zuklic et al.
7,032,666 B2 4/2006 Corbett
7,128,151 B2 10/2006 Corbett
7,290,610 B2 11/2007 Corbett et al.
2005/0061519 A1 3/2005 Wagner et al.
2006/0225878 A1 * 10/2006 Coronado ..... 166/206

OTHER PUBLICATIONS

Walker, Tim, et al., "Underbalanced Completions", SPE 30648, Oct. 1995, 185-191.
Walker, Tim, et al., "Downhole Swab Valve Aids in Underbalanced Completion of North Sea Wall", SPE 30421, Sep. 1995, 541-546.
Vozniak, J.P., et al., "Successful Horizontal Drilling and Gravel Packing in Deep and Ultra-Deepwater", SPE/IADC 67750, Mar. 2001, 1-8.

* cited by examiner

*Primary Examiner*—Jennifer H Gay
*Assistant Examiner*—Brad Harcourt
(74) *Attorney, Agent, or Firm*—Steve Rosenblatt

(57) ABSTRACT

A fluid loss valve is disposed in a wash pipe in a gravel packing assembly. It is preferably held open initially and when in the process it is time for the valve to be able to go closed a pulling force is applied that creates relative movement to either close the valve or allow it to close without release of the assembly when under tension. This allows a surface signal that the valve is to be released for closure. The tension is relieved before string movement with the valve can occur. This can happen by slacking off before picking up again or through other time delay features that allow the tension to be removed and a lock to collapse before a lift force is applied for subsequent gravel packing operations. The valve in its closed position acts to eliminate fluid loss when excess gravel is reversed out.

19 Claims, 4 Drawing Sheets

DELAYED ACTING GRAVEL PACK FLUID LOSS VALVE

FIELD OF THE INVENTION

The field of the invention is fluid loss control valves used in gravel pack or frac pack systems to protect the formation during reverse circulation of excess gravel after deposition of the gravel outside a screen.

BACKGROUND OF THE INVENTION

Gravel pack systems allow many downhole procedures to take place in a single trip. A gravel pack assembly typically contains sections of screen that extend from an isolation packer. An inner string that includes a crossover tool is movable with respect to the set packer for selective sealing relation with a polished bore in the packer. In this manner fluids can be circulated when the assembly is run in and gravel can be deposited outside the screens while return fluids can come up through the screens and up a wash pipe. These return fluids can then pass through a valve in an uphole direction and go through the crossover and back to the surface through the annulus above the set packer. Alternatively, the crossover can allow the gravel to be deposited with fluid squeezed into the formation in a procedure called a frac pack. The crossover is simply positioned with respect to the isolation packer in a manner where no return port through the wash pipe and back to the surface is open.

Regardless of whether the gravel is deposited with fluid returns to the surface or whether the fluid is forced into the formation when the gravel is deposited outside the screens, the excess gravel in the string leading down to the crossover has to be removed, typically by a process called reversing out. In this step the crossover is repositioned so that fluid pumped from the surface in the annular space above the packer is allowed into the tubing above the packer so that the excess gravel can be brought to the surface. However, performing this procedure can build pressure near the crossover and a risk of fluid loss to the formation with this built up pressure is a possibility. Fluid loss to the formation can diminish its productivity and excessive fluid loss to the formation may inhibit or prevent reverse circulating of the excess gravel from the workstring. For these reasons a fluid loss control valve in the wash pipe extending into a packer seal bore from the crossover has been used. These fluid loss control valves are illustrated in patents relating to gravel packing operations such as U.S. Pat. Nos. 7,290,610; 7,128,151; 7,032,666 and 6,983,795.

One type of valve that has been used is a flapper type. It has been sold by Baker Oil Tools under the name Flapper Anti-Swabbing Tool. This valve is part of the wash pipe and is run in held open. It is positioned below the seal bore on the packer. When it is time to close it the string is pulled up from the surface relative to the set packer. Collets associated with the valve and mounted to its exterior land on a shoulder just below the seal bore so that resistance to further pulling can be experienced at the surface to know that the valve is in position for release. This step was done before the gravel pack was delivered to the annulus outside the screens. A further pull trapped the collet heads against a shoulder adjacent the seal bore and allowed the valve body to shift relative to the collets. This relative movement resulted in breaking a shear pin and allowing a recess on the body to move adjacent the collet heads so that they could collapse radially toward the body so that the wash pipe could come up into the seal bore. The relative movement also freed the flapper to be biased by a pivot spring to go to the closed position.

The problem with this tool is that to see a surface signal a significant tensile force must be pulled and by pulling against a shear pin to generate a force in excess of 21,000 pounds, the string would stretch before the shear pin sheared. When the shear pin sheared, the flapper would go immediately closed but the stretched string would recoil to its original length. The result of these motions was to induce flow out of the formation due to a pressure reduction caused by a now closed string recoiling up through the seal bore. In certain unconsolidated formations this movement induced sand to come into the wellbore around the screens in the very place around the screens where the gravel needed to go. Once that happened it became difficult or impossible to have an effective gravel pack.

What was needed and provided by the present invention is a fluid loss valve that could give a surface signal that it has been released to close but at the same time prevented the phenomenon of drawing sand into the annulus before the gravel pack was accomplished. The present invention breaks up the signal portion at the surface and the actual movement downhole to avoid or minimize the drawing in solids issue. In the preferred embodiment the upward pull against a radial surface still gives the surface signal without and actual release. A subsequent downward movement of the tubing string allows the collets to retract inwardly to eventually clear the seal bore but takes away string tension at the time of release of the collets. The valve can selectively close either when tension is pulled without release or subsequently when tension is released. After gravel packing and reversing out the excess gravel, the wash pipe with the fluid loss valve can be pulled from the packer seal bore without interference. These and other aspects of the present invention will become more apparent to those skilled in the art from a review of the description of the preferred embodiment and the associated drawings that appear below while recognizing that the claims define the full literal and equivalent scope of the invention.

SUMMARY OF THE INVENTION

A fluid loss valve is disposed in a wash pipe in a gravel packing assembly. It is preferably held open initially and when in the process it is time for the valve to be able to go closed a pulling force is applied that creates relative movement to either close the valve or allow it to close without release of the assembly when under tension. This allows a surface signal that the valve is to be released for closure. The tension is relieved before string movement with the valve can occur. This can happen by downward movement of the tubing string before picking up again or through other time delay features that allow the tension to be removed before and a lock to collapse before a lift force is applied for subsequent gravel packing operations. The valve in its closed position acts to eliminate fluid loss when excess gravel is reversed out.

BRIEF DESCRIPTION OF THE DRAWINGS

FIG. 6 is preferred embodiment of the fluid loss valve of the present invention shown in half section and still locked in the open position during run in;

DETAILED DESCRIPTION OF THE PREFERRED EMBODIMENT

Figure 1:
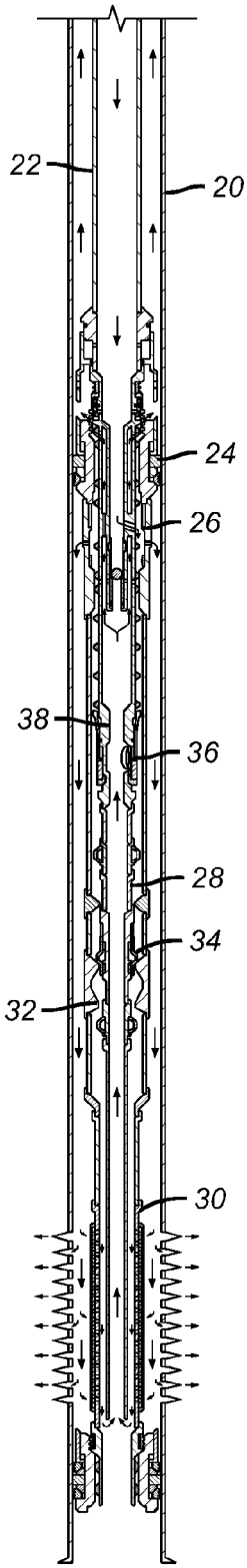
(PRIOR ART) FIG. 1
FIG. 1 is a section view of a prior art assembly in a circulating position with the fluid loss valve locked open.

As an introduction to an understanding of the preferred embodiment, a brief discussion of the prior designs and the issues it presented will be undertaken in a summary form. FIG. 1 shows a common prior art assembly for gravel packing. A wellbore 20 has a string 22 with a packer 24 shown in a set position. A crossover tool 26 with a wash pipe 28 extends through a screen assembly 30. The screen assembly 30 has profiles 32 on which a Smart Collet® 34 that is connected to the wash pipe 28 can be landed to provide the desired flow configurations for the gravel packing operation. In the FIG. 1 position a fluid loss control valve 36 is locked in the open position. The FIG. 1 position allows circulation with flow coming down the string 22 and going through the crossover tool 26 to emerge outside the screen assembly 30. Flow then goes through the screen assembly 30 and into the wash pipe 28 and through the flow control valve 36 and back through the crossover tool 26 to the annulus above packer 24 and around the string 22 to the surface.

Figure 2:
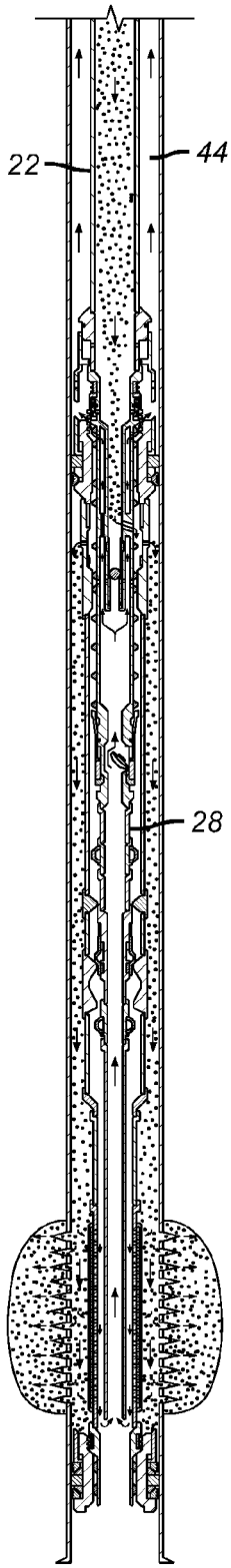
(PRIOR ART) FIG. 2
FIG. 2 is the view of FIG. 1 in a gravel delivery position with the fluid loss valve released to close but forced open by returning fluid moving through the screens.
Figure 5:
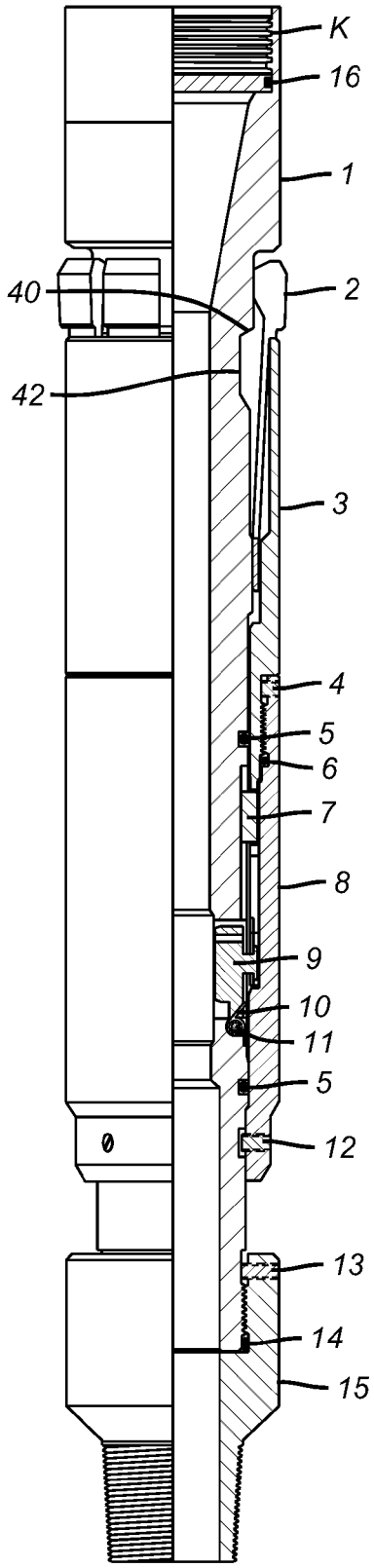
(PRIOR ART) FIG. 5
FIG. 5 is a detailed section view of the fluid loss valve of the prior art in the locked open position.

Some time between the FIG. 1 and FIG. 2 positions the string 22 is picked up to actuate the fluid loss control valve 36 into a position where it can be biased to a closed position by allowing a flapper 9 in FIG. 5 to no longer be retained by a retainer 7. The fluid loss control valve 36 is disposed immediately below a packer seal bore 38. In the run in position for the fluid loss control valve 36 the collet heads 2 shown in FIG. 5 are supported on a shoulder 40 and extend radially to the point where they cannot enter the seal bore 38. A groove 42 is offset from collet heads 2 in the run in position. However when string 22 is raised sufficiently the collet heads 2 bump just below seal bore 38 and surface personnel notice that resistance is encountered. This tells them that the collet heads have shouldered out and that further pulling to the tune of about 21,000 pounds of force or more will result in breaking the shear pin 12 and moving the body 1 relative to the collet assembly 2, 3, 4, 5, 6, 7 and 8. While the shear pin 12 breaks initially when enough force is applied to it, what happens as that force is applied and raised to the break point of the pin 12 is that the string 22 connected at threads K begins to stretch. As the pin 12 breaks, the applied tensile force that has stretched the string 22 and broken pin 12 is relieved and the string 22 recoils at the same time that relative movement between collet heads 2 and body 1 happens. The recoil begins as the body 1 moves up enough to get groove 42 next to collet heads 2 to allow them to collapse radially inwardly. By that time the retainer 7 has been defeated and a spring 10 on pivot pin 11 can force the flapper 9 to turn counterclockwise to its seat. Thus, when the string 22 recoils, the flapper 9 stays in the closed position. The net effect on the formation below is a sudden decrease in pressure from the string 22 acting like a rising piston. What this does is draw sand into the annular space around the screen assembly 30 before gravel can be deposited there. This prevents a good gravel pack or a frac pack from occurring around the screen assembly 30.

Figure 3:
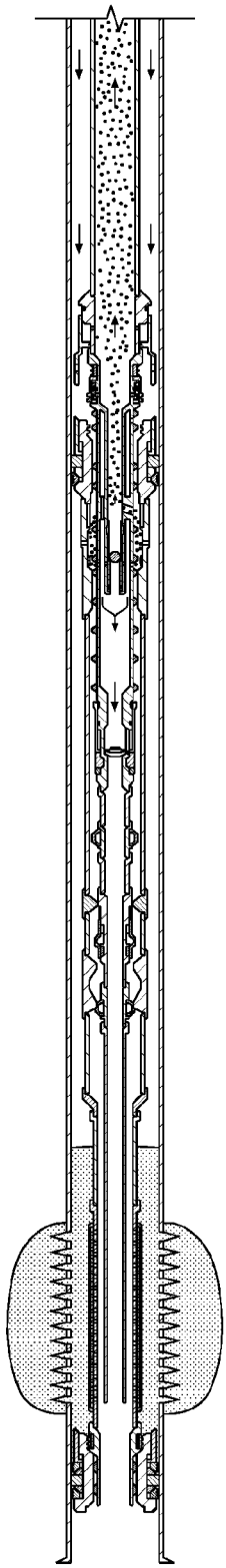
(PRIOR ART) FIG. 3
FIG. 3 is the view of FIG. 2 showing the onset of reverse flow through the crossover.
Figure 4:
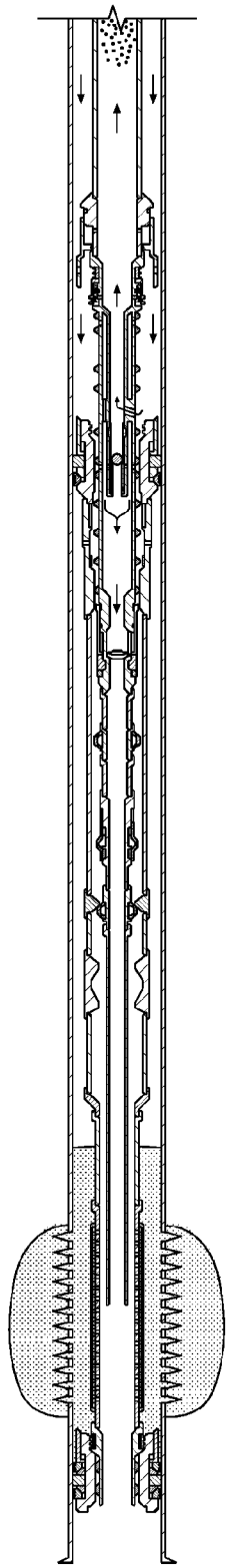
(PRIOR ART) FIG. 4
FIG. 4 is the view of FIG. 3 showing the reversing out of excess gravel from the string above the crossover.

In the normal course of prior operations the string 22 is manipulated to allow gravel deposition outside the screen assembly 30 as shown in FIG. 2. At this time returns, if circulation is used rather than a frac pack, pass through the wash pipe and prop open the flapper 9 against the bias of spring 10. Returns then go through the crossover tool 26 and into the upper annulus 44. The crossover tool 26 is manipulated again in FIG. 3 to allow reversing out the crossover tool 26 to the surface through string 22. Thereafter with further string manipulation the flow down annulus 44 goes into string 22 above the crossover tool 26 to reverse out remaining gravel in the string 22 to the surface.

The present invention focuses on a redesign of the prior fluid loss control valve shown in FIG. 5 and labeled 36. To alleviate the problem of drawing sand into the annulus around the screens the redesigned flow control valve separates the pulling tension to give the surface personnel a signal that the valve is about to be actuated from the actual movement of the valve into the seal bore 38. By doing it this way, the pressure reduction that can draw sand into the wellbore from unconsolidated formations can be eliminated. In the preferred embodiment, this separation is accomplished by keeping the tension applied from releasing the tool to move into the seal bore 38 that is above it until the tension is released. The preferred tool is configured to require downward movement of the tubing string before the tool can be subsequently advanced up into the seal bore 38. Other ways are contemplated such as forcing viscous fluid through an orifice after the shear pin is broken so that movement is regulated to go slow enough to avoid drawing sand into the annular space around the screen assembly 30. Optionally, a j-slot mechanism can be incorporated so that a predetermined number of cycles of up and down movement of the string 22 would be required to break the shear pin of the fluid loss valve. The j-slot structure can be configured to limit travel even when the shear pin breaks to avoid sucking in the sand. In the next cycle the j-slot can allow sufficient travel relative to the packer to conduct further operations and to ultimately pull the string 22 out of the packer 24.

Figure 6:
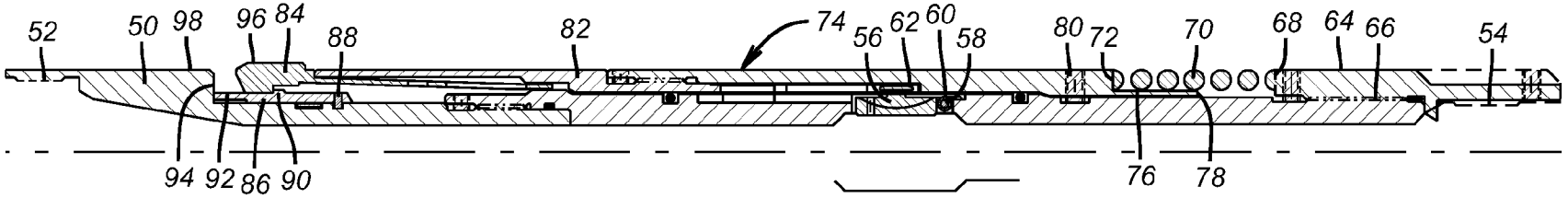

The components and operation of the preferred embodiment will now be described. Referring to FIG. 6 a body 50 has a top thread 52 to which is connected a portion of the wash pipe as shown for example in FIG. 1. Similarly, the wash pipe continues at the lower thread 54. Body 50 extends between threads 52 and 54. In between a flapper 56 is pinned at 58 with a torsion spring 60 on pin 58 to bias the flapper 56 in a counterclockwise direction. In the run in position of FIG. 6 the flapper 56 extends into a groove 62 and is prevented from rotation from the force of the spring 60 or from its own weight. A bottom sub 64 is secured to body 50 at thread 66 to present an exterior shoulder 68. Spring 70 pushes up on shoulder 72 of the collet assembly 74. Collet assembly 74 has a lower extension 76 that has a lower end 78. The lower extension is initially under the spring 70 and the lower end 78 is designed to be a travel stop when it contacts shoulder 68 on bottom sub 64.

The collet assembly is pinned to the body 50 with shear pin 80. Collet assembly 74 comprises a ring 82 near its upper end from which a series of collet fingers extend with heads 84. In the run in position the collet heads 84 rest on a sleeve 86 pinned at pin 88 to the body 50. In the run in position of FIG. 6 the collet heads 84 abut an extending ring 90 and outer surface 92 on the sleeve 86. The top end of the sleeve 86 is initially abutting surface 94 on the body 50. Initially the outer surface 96 of collet heads 84 extends radially further than surface 98 on body 50.

Figure 7:
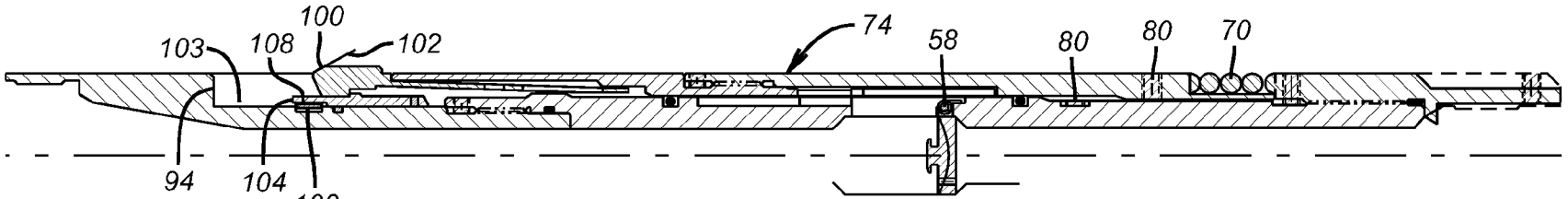
FIG. 7 is the view of FIG. 6 after an upward pull that is resisted by the extended collets.

In operation, the string 22 is raised to raise body 50 until tapered surface 100 on collet heads 84 engages a stop surface 102. This stop surface can be a shoulder just below a seal bore such as 38 or another available profile in the wash packer assembly 24. FIG. 7 shows the tapered surface 100 hitting a no-go. At this point further force from picking up the string 22 continues to lift the body 50 while the collet assembly 74 cannot move. This results in shearing pin 80 and compressing spring 70 until the lower end 78 hits bottom against surface 68. What actually happens first near the top of body 50 is that upward movement of body 50 shears the weaker pin 88. As the body 50 moves up after pin 88 shears the overhang on collet heads 84 over the ring 90 on sleeve 86 a gap 103 develops between moving surface 94 and the top end 104 of the sleeve 86. The upward movement of pin 58 holding the flapper 56 relative to collet assembly 74 and its retaining groove 62 allows the spring 60 to rotate the flapper 56 into the closed position shown in FIG. 7. However, there is no release past the no-go surface 102 with tension being pulled at thread 52.

Figure 8:
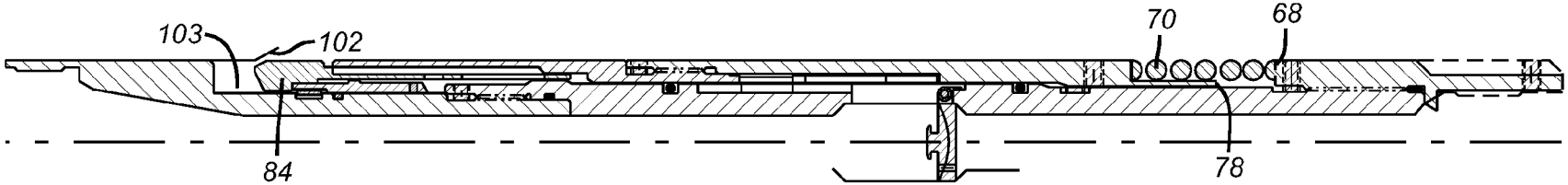
FIG. 8 is the view of FIG. 7 with the pull force removed.
Figure 9:
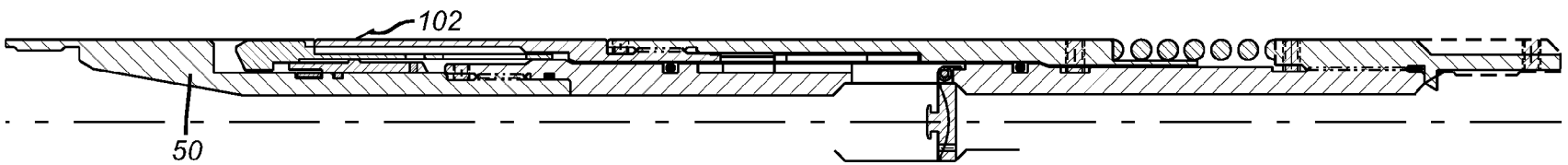
FIG. 9 is the position of the valve of FIG. 8 as it is pulled through the packer seal bore.

The next step shown in FIG. 8 is for the tension force at thread 52 to be released. At this time the sleeve 86 is held to body 50 by a snap ring 106 that has expanded into groove 108 when brought into alignment with it in FIG. 7. Lowering the tubing string, as shown in FIG. 8, brings the gap 103 into alignment with collet heads 84 and this allows the collet heads to retract radially to clear the no-go 102. Spring 70 has relaxed somewhat from its position in FIG. 7 when the tension force was being applied. In FIG. 8 with no tension force applied to thread 52 the spring 70 lifts the lower end 78 of the collet assembly 74 away from shoulder 68. At this point the string 22 can be manipulated to accomplish the gravel packing by squeezing or with circulation as done in the past. The difference is that there has been no string recoil on release of the fluid loss valve as in the past so that the drawing in of sand from the formation is minimized, if not eliminated.

Finally, when a pickup force is applied the collet assembly 74 can go past the no-go 102.

Figure 10:
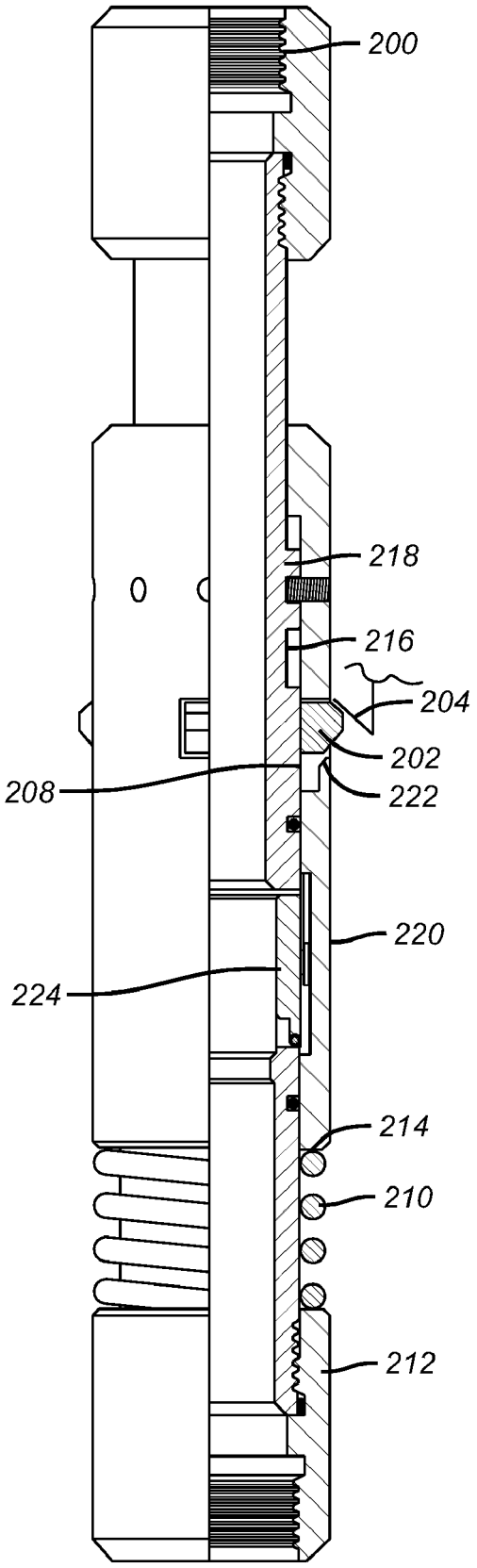
FIG. 10 is an alternative embodiment to the design in FIGS. 6-9.

FIG. 10 shows a variation. A string is connected at thread 200 and dogs 202 are designed to contact a no-go 204 so that an applied pickup force will shear pin 206 while continuing to support dogs 202 in the extended position off of surface 208. At the same time that the pin 206 is sheared, the spring 210 is compressed as bottom 212 moves up and surface 214 is held stationary by the extension of dogs 202 against the no-go 204. It is only when the string (not shown) is slacked off that groove 216 in body 218 lines up with dogs 202 that during the slacking off of the string are held against no-go 204 by spring 210. Spring 210 relaxes as weight on the string is slacked off so that when the dogs 202 are aligned with grooves 216 there is little or no applied tension in the string and the spring 210 is able to push on sleeve 220 whose surface 224 cams the dogs 202 back into grooves 216 to allow body 218 to move up so that gravel deposition and/or fracturing can take place in a known manner. As with the other embodiment, the flapper 224 that was initially held open by sleeve 220 is released to close upon relative movement between the body 218 and the sleeve 220 as the dogs 202 abut the no-go 204 and tension is pulled on the string. A variation that doesn't release the flapper 224 until the string is slacked off is also contemplated.

Variations are envisioned. Flapper 56 can continue to remain open when the pick up force is applied in FIG. 7 instead of closing at that time. If that is the case, then the flapper 56 can close at the time the tubing string is moved downward such as in FIG. 8. Alternatively, the subsequent movement after the shear pin such as 80 or 12 in the prior design can be regulated or limited so as to reduce the recoil effect. The applied pickup force can be configured to push a piston against fluid that can be metered through an orifice. A rupture disc can be added to the assembly to require a predetermined initial force close to the designed failure point of the shear pin before the rupture disc breaks and allows fluid to be displaced through an orifice for a slow regulated movement of the body of the tool so as not to draw in sand into the surrounding annulus. An alternate approach can involve using a j-slot mechanism that will involve cycles of pulling tension and slacking off for a predetermined number of cycles where no load is placed on the shear pin 80 or 12 when the string is in tension until the predetermined cycles are completed. After that, the next tension cycle has a longer slot to allow the pin to shear but to only allow just enough relative movement so that little or no further movement uphole can happen after the pin is sheared. This is followed by a set down and pick up cycle to allow a pin to exit the j-slot for the needed manipulation to accomplish the gravel deposition and fracture steps and ultimate removal of the assembly from the set packer.

The invention allows for a surface signal that a string mounted valve is against a no-go in a wellbore coupled with release of the valve past the no-go at a time when the tension on the string is either eliminated by slacking off weight or reduced during a time delay period initiated when the tension was applied. Alternatively, release can be accomplished from the no go but with limited ability for the string to recoil after an initial step toward release, followed by string manipulation to accomplish the release without applied tensile force.

The above description is illustrative of the preferred embodiment and various alternatives and is not intended to embody the broadest scope of the invention, which is determined from the claims appended below, and properly given their full scope literally and equivalently.

We claim:

1. A method of operating a string mounted tool in a wellbore, comprising:

engaging an external mechanism on the tool to a no-go in the wellbore;

pulling tension on said string for a signal that said no-go is engaged without being able to advance the tool past the no-go from application of a tension;

eliminating said pulled tension so that said mechanism is enabled to pass said no-go.

2. The method of claim 1, comprising:

allowing said external mechanism to collapse away from said no-go from said eliminating said pulled tension.

3. The method of claim 2, comprising:

actuating said tool when pulling tension.

4. The method of claim 2, comprising:

actuating said tool when eliminating said pulled tension.

5. A method of operating a string mounted tool in a wellbore, comprising:

engaging an external mechanism on the tool to a no-go in the wellbore;

pulling tension on said string for a signal that said no-go is engaged;

reducing or eliminating said pulled tension before said mechanism passes said no-go;

slacking off on said string after said pulling tension;

allowing said external mechanism to collapse away from said no-go from said slacking off movement;

providing as said tool a flapper valve held open in a tubular body and a collet or dog assembly that extends initially radially outwardly to engage said no-go to allow string tension to be pulled;

creating relative movement between said collet or dog assembly and said body while retaining said collet or dog assembly to said no-go.

6. The method of claim 5, comprising:

releasing an initial connection between said collet or dog assembly and said body with said pulling tension;

energizing a bias force acting on said collet or dog assembly with said releasing.

7. The method of claim 6, comprising:

moving a support sleeve with said collet assembly relative to said body when pulling said tension and thereafter locking said support sleeve to said body.

8. The method of claim 7, comprising:

using said bias after said slacking off movement to move said collet assembly in part beyond said sleeve to allow said body to pass through said no-go.

9. The method of claim 5, comprising:

holding said flapper open with said collet or dog assembly and releasing said hold on said flapper using relative movement between said collet or dog assembly and said body created by said pulling tension or by said slacking off movement.

10. A method of operating a string mounted tool in a wellbore, comprising:

engaging an external mechanism on the tool to a no-go in the wellbore;

pulling tension on said string for a signal that said no-go is engaged;

eliminating said pulled tension before said mechanism is enabled to pass said no-go;

using a time delay device to allow pulling tension for a time before said external mechanism can pass said no go.

11. The method of claim 10, comprising:

using fluid pushed through an orifice as said time delay;

reducing said pulled tension during said time delay.

12. A method of operating a string mounted tool in a wellbore, comprising:

engaging an external mechanism on the tool to a no-go in the wellbore;

pulling tension on said string for a signal that said no-go is engaged;

reducing or eliminating said pulled tension before said mechanism passes said no-go;

using a j-slot mechanism to connect said external mechanism to a tool body;

configuring said j-slot mechanism to selectively allow said pulled tension to act on a breakable member that holds said external mechanism against said no-go;

shaping said j-slot mechanism to limit tool body movement relative to said external mechanism still retained by said no-go after breaking said breakable member;

manipulating said j-slot mechanism after breaking said breakable member to advance said external mechanism past said no-go.

13. A release system for a fluid loss valve in a gravel pack assembly, comprising:

a packer supporting a screen assembly;

a string extending through said packer having a fluid loss valve thereon, said fluid loss valve having a body and an external assembly selectively initially extending radially to engage a no-go supported by said packer;

said external assembly preventing said valve from passing said no-go with applied tension to said string until said applied tension is eliminated, said elimination of applied tension and setting down weight on said body allows said external assembly to initially retract to pass said no-go.

14. The system of claim 13, wherein:

said body moves relative to said external assembly when said tension is applied to break a connection between them.

15. The system of claim 13, wherein:

said fluid loss valve comprises a flapper initially held open until at least tension is applied to said string.

16. The system of claim 15, wherein:

said flapper is released by relative movement between said external assembly and said body.

17. A release system for a fluid loss valve in a gravel pack assembly, comprising:

a packer supporting a screen assembly;

a string extending through said packer having a fluid loss valve thereon, said fluid loss valve having a body and an external assembly selectively initially extending radially to engage a no-go supported by said packer;

said external assembly preventing said valve from passing said no-go with applied tension to said string until said applied tension is reduced or eliminated;

said body moves relative to said external assembly when said tension is applied to break a connection between them;

said external assembly comprises at least one biased collet or dog with said bias force energized by said relative movement between said body and said collet or dog.

18. The system of claim 17, wherein:

said collet carries a movable sleeve with it during said relative movement with respect to said body, said sleeve becoming engaged to said body after moving relatively to said body.

19. The system of claim 18, wherein:

said bias moves said collet past said sleeve upon reduction or removal of said applied tension to said string to allow said collet to radially collapse so that it can pass said no-go.

* * * * *